US005575676A

United States Patent [19]

Tsukakoshi et al.

[11] Patent Number: 5,575,676

[45] Date of Patent: Nov. 19, 1996

[54] CAM-EQUIPPED CONNECTOR

[75] Inventors: Masao Tsukakoshi, Machida; Kazuhisa Betsui, Yokohama, both of Japan

[73] Assignee: The Whitaker Corporation, Wilmington, Del.

[21] Appl. No.: 371,248

[22] Filed: Jan. 11, 1995

[30] Foreign Application Priority Data

Feb. 25, 1994 [JP] Japan ..... 6-028251

[51] Int. Cl.[6] ..... H01R 4/50

[52] U.S. Cl. ..... 439/347; 439/157

[58] Field of Search ..... 439/152–160, 439/259, 260, 362, 345, 347

[56] References Cited

U.S. PATENT DOCUMENTS

| | | | |
|---|---|---|---|
| 4,332,432 | 6/1982 | Colleran | 439/347 |
| 4,586,771 | 5/1986 | Kramer et al. | 339/75 |
| 5,183,408 | 2/1993 | Hatagishi | 439/157 |
| 5,391,086 | 2/1995 | Woller et al. | 439/157 |

FOREIGN PATENT DOCUMENTS

| | | |
|---|---|---|
| 0549370 | 6/1993 | European Pat. Off. . |
| 0581638 | 2/1994 | European Pat. Off. . |
| 0625809 | 11/1994 | European Pat. Off. . |
| 5-90846 | 12/1993 | Japan . |

OTHER PUBLICATIONS

Canadian Patent Application 2123972 which is an English language equivalent to EP 0 625 809 Nov. 1994.

*Primary Examiner*—David L. Pirlot

[57] ABSTRACT

In order to prevent deformation of contacts of connectors during their joining and to reduce the effort required for their connection without resorting to an increase in size, a cam-equipped connector has a facility for an intermediary joining. To prevent deformation of contacts, the female connector 10, equipped with a cam device 30, has protrusions 14 extending from the bottom surface 11*a* of a joining cavity 11 which are longer than contact sections of the male contacts. Cavities 24 intended for reception of the protrusions 14 are made in the joining surface 21 of the male connector 20. The protrusions 14 and the cavities 24 have maintaining steps 14*a* and maintaining lugs 24*a* for an intermediary joining of the connectors 10, 20.

18 Claims, 6 Drawing Sheets

CAM-EQUIPPED CONNECTOR

FIELD OF THE INVENTION

This invention relates to electrical connectors, especially to cam-equipped connectors in which male and female connectors in an intermediary joined position can be easily joined completely using a cam device requiring only low effort.

BACKGROUND OF THE INVENTION

Several types of such cam-equipped connectors are known in the art. For example, a connector described in U.S. Pat. No. 4,586,771 consists of a male connector with a cam groove and a female connector having a slide-type cam with a pin fitting in the cam groove, and the female connector is equipped with a slide type cam having a cam groove matching with a pin formed on the male connector as a cam follower. In addition, in Japanese Utility Model Publication No. 93-90846, another type of connector is described. It consists of a female connector equipped with a rotary-type cam having a groove matching with a pin formed on the male connector.

In these connectors equipped with cam devices, it is necessary to retain both connectors in a temporary joined position before operating the cam, but in conventional cam-equipped connectors, there is no device to retain the connectors in the temporary joined position. Therefore, when joining conventional cam-equipped connectors, the operator had to keep them in the temporary joined position while operating the cam, thus making this process very difficult.

In order to make operation of such cam-equipped connectors easier, it is possible to provide them with devices for temporary joining both connectors. But the problem is where exactly this temporary joining device should be located.

Generally, temporary joining devices are often in the form of lugs, etc. on the walls forming the joining cavity of the female connector to retain the male connector. However, if lugs are located on the walls of joining cavity of the female connector, it is necessary to provide grooves or depressions in the walls, thus reducing their strength. But when the cam device is operated, the walls of the joining cavity experience rather high stress. Therefore, it is not desirable to reduce the strength of the walls. This can be done by increasing thickness of the walls, but it is not desirable either, since it will lead to an increase in size.

In addition, the cam-equipped connectors have the following disadvantages. In order to join the connectors, they have to be temporarily joined. If, during this temporary joining, the male connector is not properly aligned relative to the joining cavity of the female connector, edges of the male connector can come against male contacts located in the joining cavity and deform them; in some cases such deformation is referred to as "twisting". In many applications the connectors are joined manually which substantially increases the danger of contact deformation.

SUMMARY OF THE INVENTION

This invention takes into consideration the information mentioned above, and its purpose is to offer a cam-equipped connector which makes it possible to avoid deformation of contacts during temporary joining without detrimental effect to the strength of the joining cavity of the female connector and without increasing the dimension of both connectors. For the above stated purposes, the cam-equipped connector according to this invention is characterized by the fact that protrusions are made on the bottom surface of the joining cavity of the female connector, which are longer than the length of contact sections of the male contacts; the joining surface of the male connector has cavities provided for reception of the protrusions; and that in the matching portions of the protrusions and cavities, an intermediary retaining device is provided to temporarily retain both connectors in a temporary joined position.

The cam-equipped connector according to this invention makes it possible to avoid deformation of male contacts located inside the joining cavity, even when an attempt is made to insert the male connector into the female connector at an angle, by providing protrusions at the bottom surface of the joining cavity of the female connector which prevent interaction of the male connector with the male contacts located in the joining cavity.

In addition, due to the device for temporary joining the connectors, the worker does not have to hold them in the intermediary joined position while operating the cam device, thus raising the effectiveness of the cam device. And since the device for temporary joining is located in the matching portions of the protrusions provided at the bottom surface of the joining cavity of the female connector and the matching cavities provided on the joining surface of the male connector, the strength of the walls forming the joining cavity of the female connector is not compromised without resorting to increasing their thickness which would lead to an increase in connector dimensions.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 1:
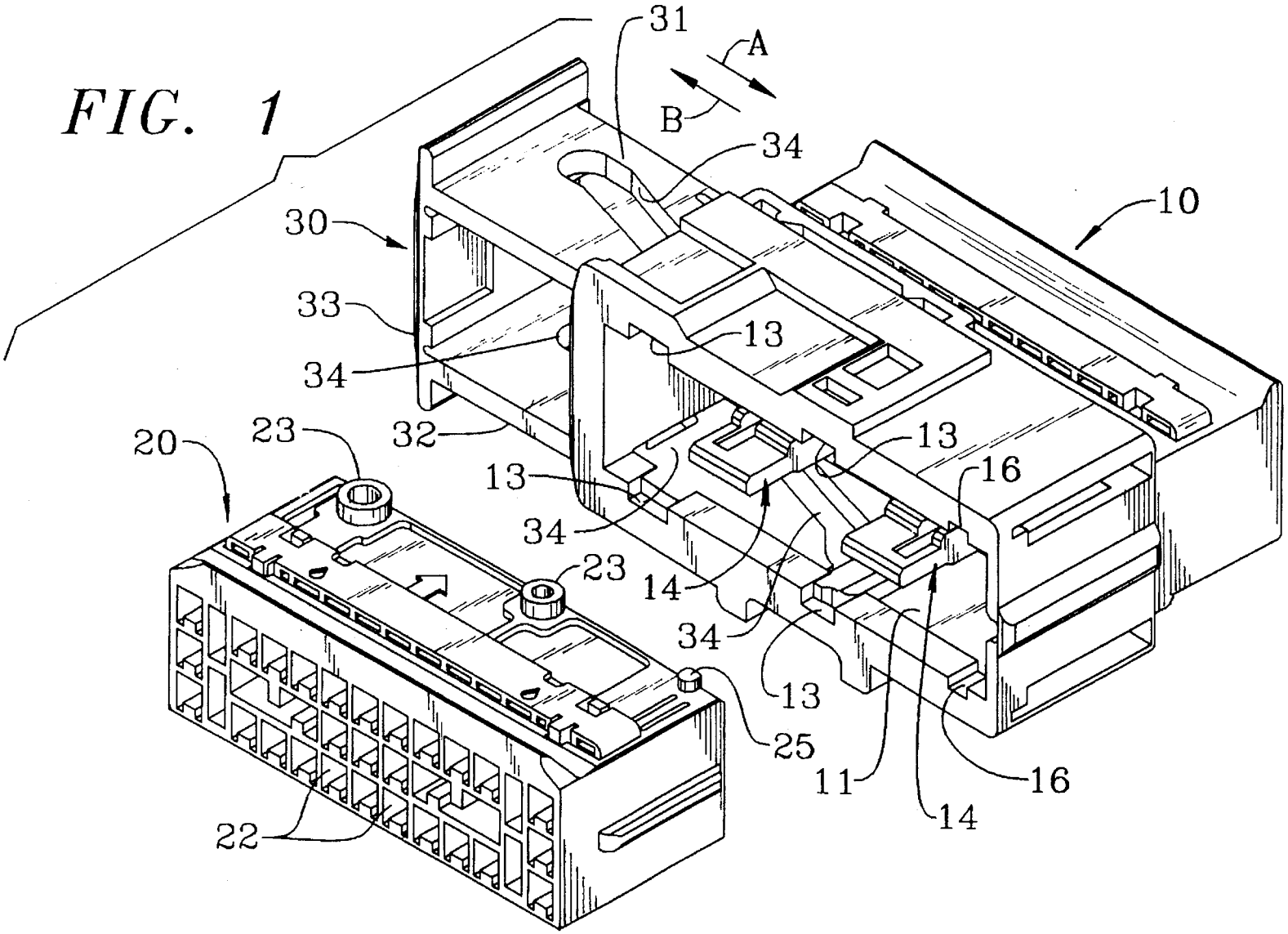
FIG. 1 is an exploded perspective view of the exterior of the cam-equipped connector according to this invention.
Figure 2:
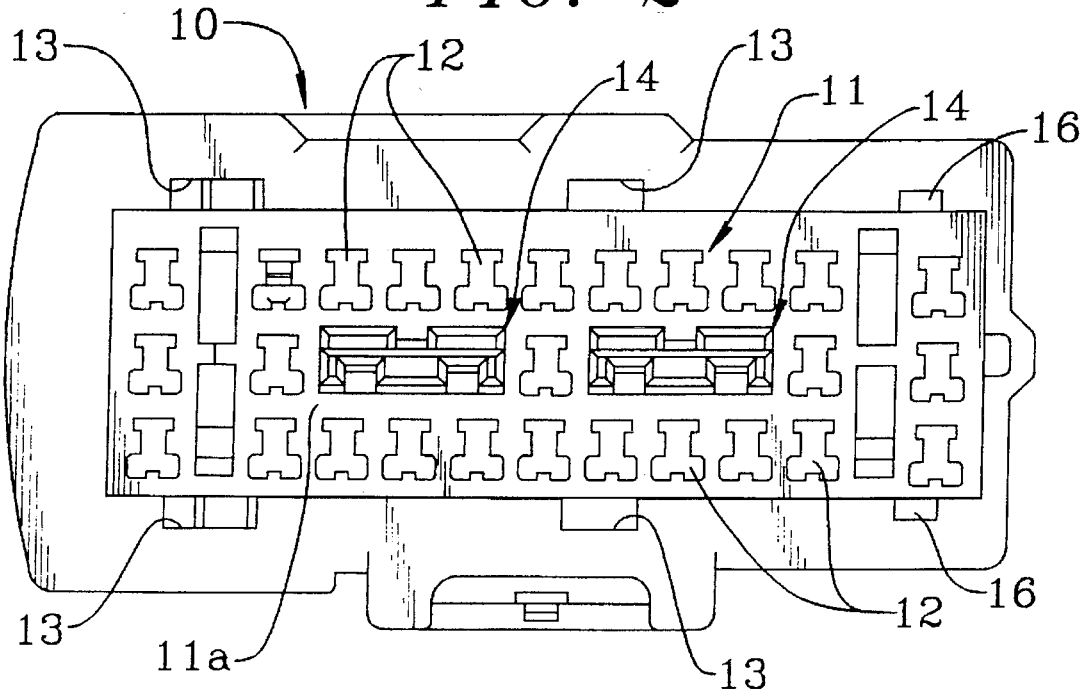
FIG. 2 is a front view of the female connector shown in the FIG. 1.

FIG. 1 is an oblique exploded projection of an embodiment of the cam-equipped connector according to this invention showing an overall view of the male and female connectors constituting it. FIG. 2 is a front view of the female connector; and FIG. 3 is a front view of the male connector.

FIGS. 1–6 show the housings of the female connector 10 and the male connector 20. The contacts used in connectors 10 and 20 are not shown. A female connector 10 like that shown in the FIG. 1 has a joining cavity 11 intended for the insertion of a male connector 20 thereunto. At the bottom surface 11*a*, shown in FIGS. 2 and 4, of this joining cavity, multiple contact holding openings 12 are made to accommodate male contacts (not shown in FIG. 1).

Figure 3:
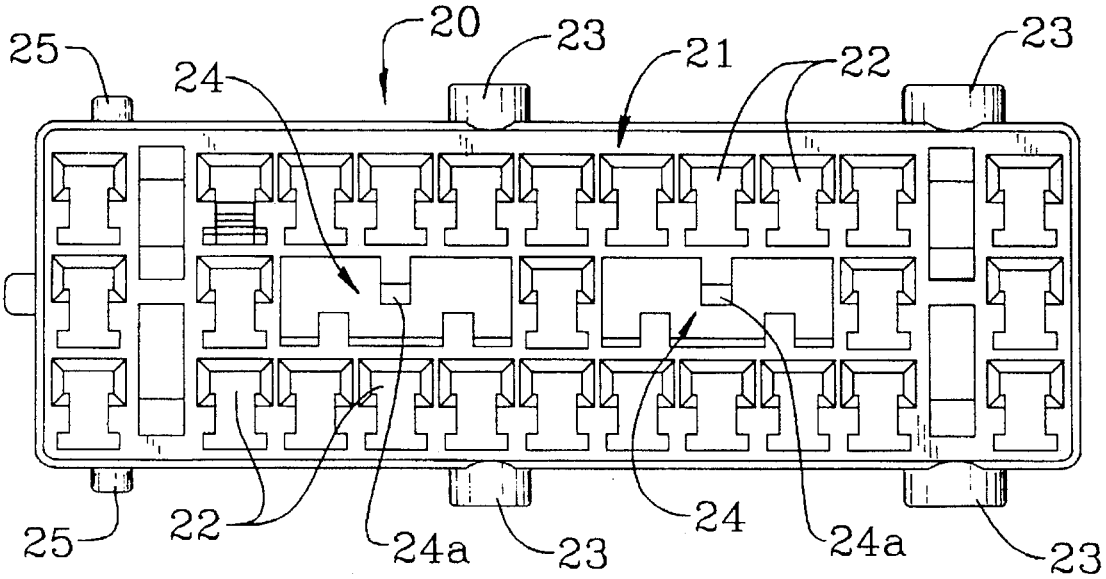
FIG. 3 is a front view of the male connector shown in the FIG. 1

On the other hand, as can be seen from the FIG. 3, the male connector 20 has an end joining surface 21 which comes in contact with the bottom surface 11*a* of the joining cavity 11 of the female connector 10 when the connectors are joined together. A number of contact holding openings 22 are made in the end joining surface 21 to accommodate female contacts (not shown in FIG. 3) intended for connection with the male contacts of the female connector 10. The female contacts which could be used in the male connector 20 are conventional in construction, and any number of standard female contacts could be employed. The structures of the housings is more clearly seen if these standard contacts are omitted. For this reason, the female contacts have not been shown.

As shown in the FIG. 1, the cam device 30 of the female connector 10 slides in lateral direction (in the drawing, it is directions AB) inside the joining cavity 11. This cam device consists of upper wall 31 and lower wall 32 connected by side walls 33. In the upper and lower walls 31 and 32, two cam grooves 34 are located (shown only partially in FIG. 1).

On the other hand, as shown in the FIG. 3, on the upper and lower sides of the male connector 10, two follower pins 23 are provided which fit into the cam grooves 34 of the cam device 30. As can be seen from the FIGS. 1 and 2, at the front edge of the joining cavity 11 of the female connector 10, guiding grooves 13 are located to direct the follower pins 23 into the cam grooves 34 of the cam device 30.

Figure 4:
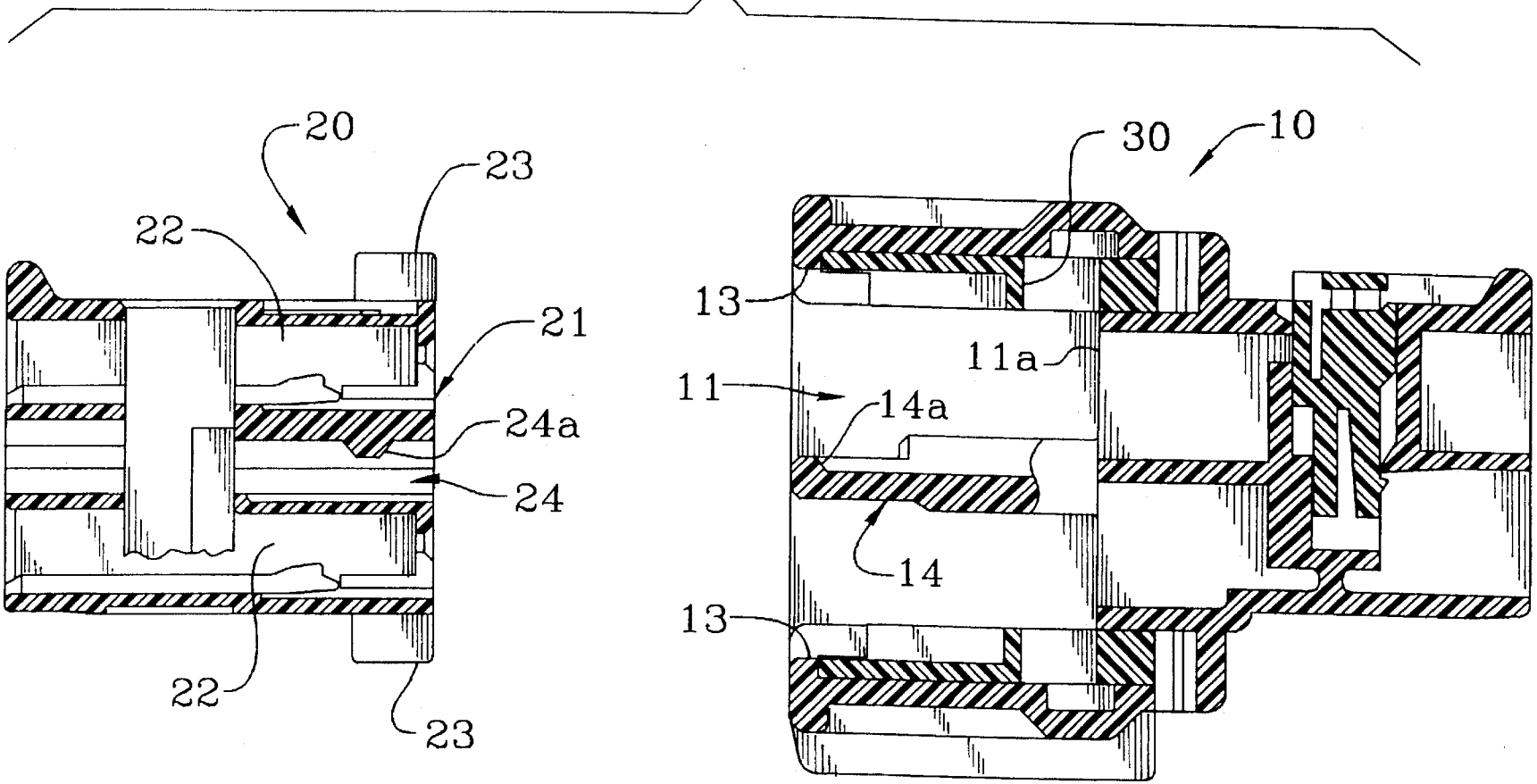
FIG. 4 is a cross-sectional view of the female and the male connectors shown in the FIG. 1.

FIG. 4 is a vertical cross section of the male and female connectors shown in the FIG. 1. In the female connector 10, the position of the cross section of the protrusion 14 is different.

As shown in FIGS. 1, 2 and 4, two beam-like protrusions 14 extend from the bottom surface 11*a* of the joining cavity 11 of the female connector 10 which extend in the direction of joining. These protrusions 14 are longer than the length of contact sections of the male contacts inserted in the female connector 10. 0n the other hand, as shown in FIGS. 3 and 4, the male connector 20 has two cavities 24 for receiving these protrusions 14.

As can be seen from the FIG. 4, steps 14*a* are located near the tip of the protrusions 14, and lugs 24*a* matable with the steps 14*a* are located near the front end of the cavities 24. These steps 14*a* and lugs 24*a* form the device for temporary joining. When connectors 10 and 20 are brought from the position shown in FIG. 4 to a position of temporary joining (that is, the position in which the follower pins 23 can enter the guiding grooves 13), this temporary joining device maintains of the connectors 10 and 20 in a temporary joining position.

Below, an explanation concerning the operation of the above embodiment is given. When connectors 10 and 20 are joined together, the male connector 20 is first inserted in the joining cavity 11 of the female connector. If at that time the male connector 20 is not inserted straight, it is stopped by the protrusions 14 of the connector 10. This makes it possible to prevent deformation of contacts.

If the male connector 20 is properly inserted in the joining cavity 11, the protrusions 14 of the female connector 10 enter in the cavities 24 of the male connector 20, and as the male connector 20 is inserted further until it reaches the position of temporary joining, the lugs 24*a* in the cavities 24 and the steps 14*a* in the protrusions 14 become engaged, thus providing for intermediary connection and maintaining the connectors 10, 20 at this temporary joining position.

After the connectors 10 and 20 were joined in the intermediary position, the cam device 30 is slid in the direction "A", thus bringing both connectors in the position of full joining using only low effort.

Figure 5:
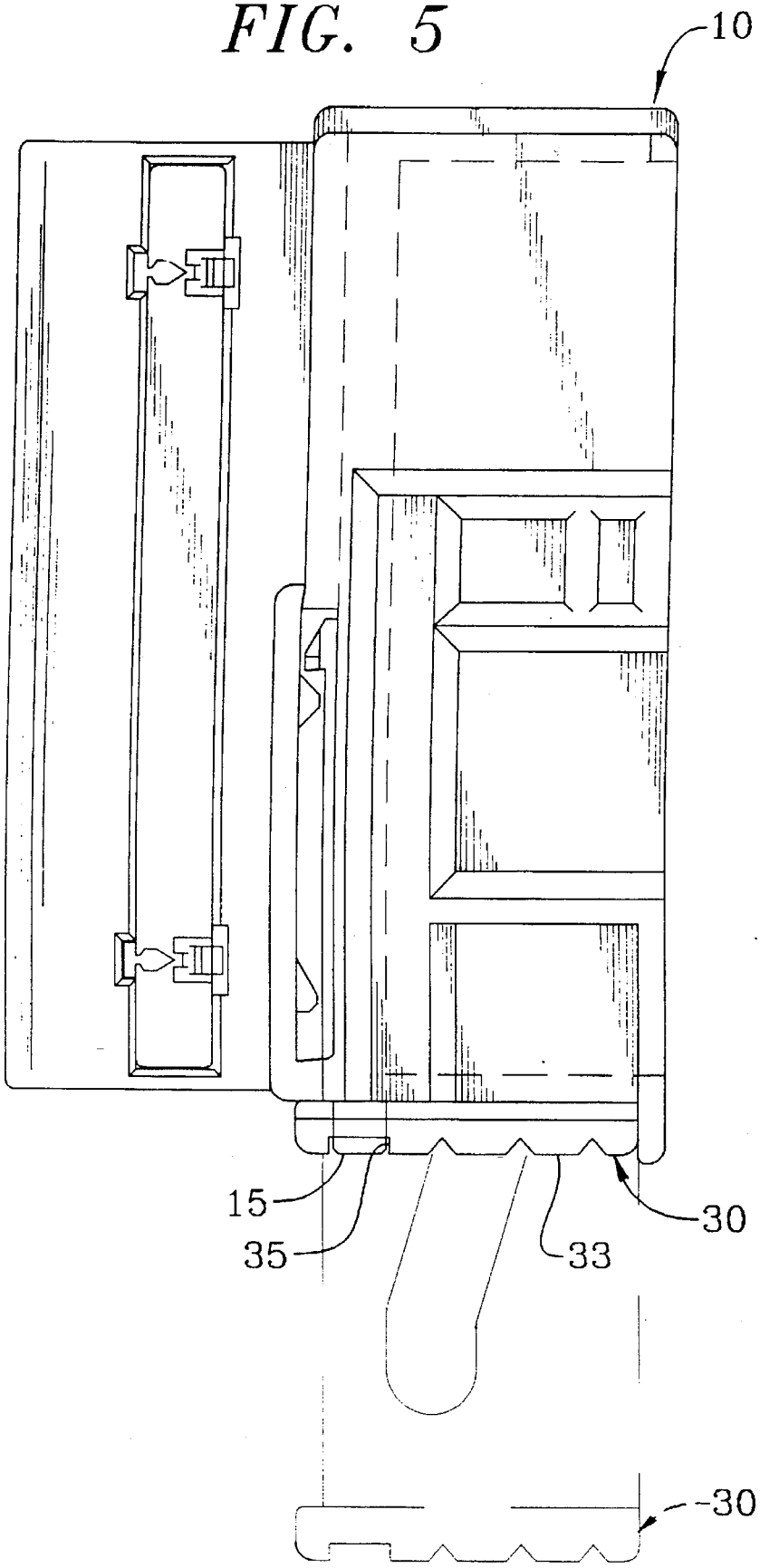
FIG. 5 is a top view of the female connector shown in FIG. 1.
Figure 6:
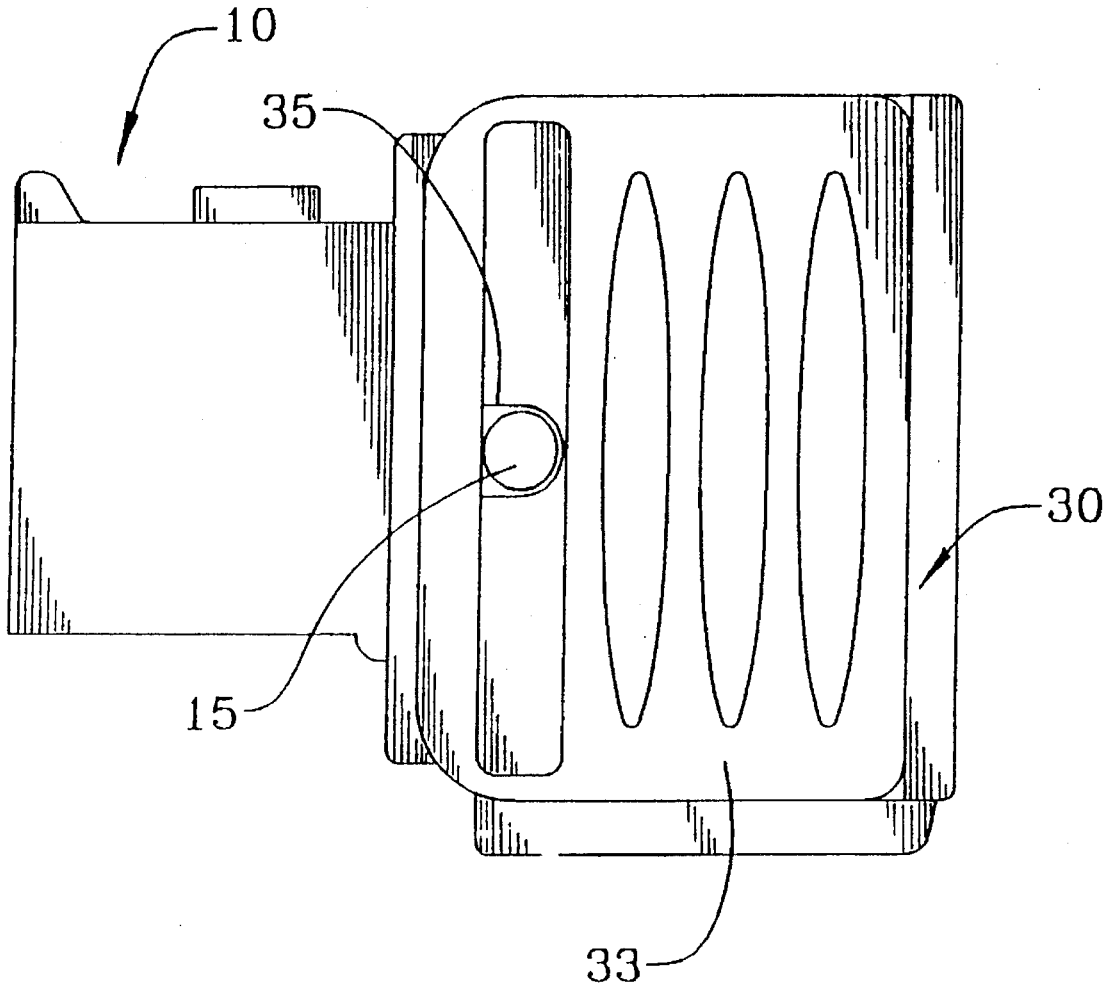
FIG. 6 is a side view of the male connector shown in the FIG. 1.

In addition, this embodiment, in order to be able to check if connector 10 and 20 are fully engaged, an opening 35 is located in the side wall 33 of the cam device 30 (see FIGS. 5 and 6). When the cam device 30 is in the position corresponding to the full engagement of connectors 10 and 20 (shown in FIG. 5 by a solid line) pin 15, located on the female connector 10, appears through the opening 35. In order to make the pin 15 more noticeable, it is made of the same color as the female connector 10, and the cam device 30 is made of a contrasting color. Since it is also possible to check if the pin 15 sticks out of the opening 35 by touch, the worker has an additional option to check if the connectors 10 and 20 are joined fully or not.

As shown in FIGS. 1 and 2, at the upper and lower front edges of the joining cavity 11 of the female connector 10, grooves 16, which are different from the guiding grooves 13, are located. These grooves 16 are provided for pins 25 (which are different from the follower pins 23) located on the upper and bottom sides of the male connector 20.

Grooves 16 and pins 25 perform the following functions. They are provided for the purpose of prevention of loss of the cam device 30 from female connector 10 during shipment and handling of finished connectors. During shipment, the cam device 30 is slid in the direction "A" as indicated in the FIG. 1. Without grooves 16 and pins 25, if an attempt is made to insert the male connector 20 into the joining cavity 11 with the cam device 30 slid into it, the worker may incorrectly assume that connectors 10 and 20 are fully engaged, while only a portion (a part up to the place where the pins 25 are located) of the male connector 20 is inserted. If an attempt is made to join connectors 10 and 20 with the grooves 16 and pins 25 in this state, the pins 25 will enter grooves 16 only to the edge of the cam device 30, thus preventing the possibility of such an erroneous joining. Pins 25 also assist in prevention of contact deformation. Without pins 25, the front part of the male connector 20 approximately up to the location of pins 25, may be inserted inside the joining cavity 11, thus causing deformation of male contacts. However, because of the pins 25, the male connector can be inserted in the joining cavity 11 only if its front part moves freely along the guiding grooves 13 and grooves 16.

Figure 7:
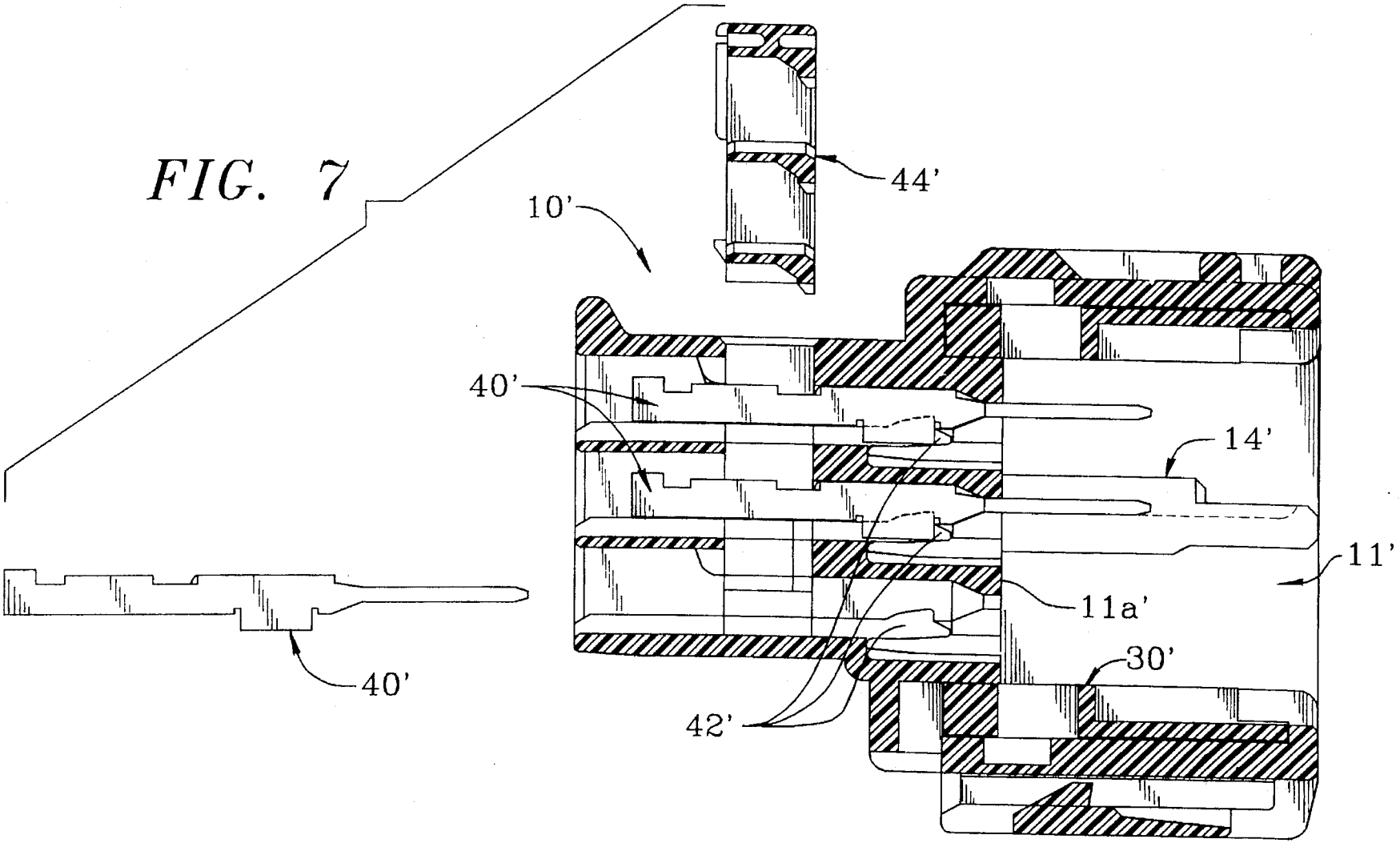
FIG. 7 is a cross-sectional view of an alternate, but substantially similar, embodiment of a female connector showing the male contacts.

FIG. 7 is a cross-sectional view of an alternate embodiment of the female connector 10', which differs only in insignificant details not relevant to the structure and operation of the protrusions and cam device. This alternate embodiment, like the first embodiment has three rows of contacts 40'. FIG. 7 shows that the contacts 40' are inserted from the rear of the housing of the connector 10'. FIG. 7 shows a contact 40' exploded from the rear of the housing of connector 10' and contacts 40' located of the housing of connector 10'. The contacts 40' are held in position by housing lances 42'. The position of the contacts 40' in the lower two rows, relative to the protrusion 14', is substantially the same as relative positions of contacts and protrusion 14 in connector 10. The protrusion 14' in the joining cavity 11' extends further forward from the bottom surface 11*a'* of the joining cavity 11' than the contacts 40'. Protrusion 14' thus extends beyond the front ends of contacts 40' where the protrusion would be initially engaged by a misaligned mating male connector in the same fashion previously described with reference to the first embodiment. FIG. 7 also shows the cam device 30'. A secondary lock 44' is shown exploded from the housing of connector 10'. When all of the contacts 40' are fully inserted through the secondary lock 44'; it can be moved to a secondary lock position and the contacts 40' are held by housing lances 42' and by secondary lock 44'.

Two specific representative embodiments of the cam-equipped connectors according to this invention have now been described in relevant detail. However, this invention is limited to not only these specific designs, but the invention also comprises its various modifications which would be apparent to one of ordinary skill in the art.

For example, the intermediary joining of connectors 10 and 20 according to this invention can be implemented in a different manner.

In addition, the configuration of the sliding cam device can be changed compared to that used in this embodiment. This invention also covers connectors having cam devices of rotary type.

What is claimed is:

1. A cam-equipped connector assembly comprising a female connector for male contacts and a male connector for female contacts, one of which is equipped with a cam device which makes it possible, by operating said cam device, to join said connectors from an intermediary-joined position to the fully-joined position using only minor effort, characterized in that protrusions are located on a bottom surface of a joining cavity of the female connector adjacent the middle of said joining cavity, which are longer than the length of contact sections of the male contacts, on a joining surface of said male connector, cavities are provided for reception of said protrusions, and that said protrusions and cavities are matched to each other and have intermediary retaining devices to temporarily retain both connectors in the intermediary joined position.

2. A cam-equipped connector assembly comprising a female connector for male contacts and a mating male connector, one of said female and male connectors being equipped with a cam device for moving said connectors from an intermediary-joined position to the fully-joined position, characterized in that at least one protrusion extends from a bottom surface of a joining cavity of the female connector adjacent the middle of said joining cavity, the protrusion being longer than the length of the contact sections of the male contacts and extending beyond the contact sections of the male contacts, at least one cavity in a joining surface of said male connector, said cavity receiving said protrusions when said female and male connectors are joined, and that said protrusions and said male connector cavity are matched to each other defining an intermediary-retaining device to temporarily retain both connectors in the intermediary-joined position.

3. The cam-equipped connector assembly of claim 2 wherein said cam device is mounted in said female connector.

4. The cam-equipped connector assembly of claim 2 wherein said cam device slides laterally and perpendicular to said protrusion when said connectors are moved from said intermediary-joined position to said fully-joined position.

5. The cam-equipped connector assembly of claim 2 wherein said male connector includes pins received in cam grooves on said cam device, said pins being insertable into said cam grooves when said male and female connectors are in said intermediary-joined position.

6. The cam-equipped connector assembly of claim 2 wherein pins are located on said male connector, said pins engaging said cam device to prevent insertion of said male connector into said female connector if said cam device is in the position corresponding to said fully joined position before said connectors are mated.

7. The cam-equipped connector assembly of claim 2 wherein said female connector includes a pin on the female connector and the cam device includes an opening, said pin protruding through said cam device opening when the cam device is shifted to a position corresponding to said fully-joined position.

8. The cam-equipped connector assembly of claim 2 wherein said protrusion extends from the bottom surface of said joining cavity adjacent the middle of said joining cavity.

9. The cam-equipped connector assembly of claim 8 wherein the joining cavity is formed in pan by upper and lower front edges extending from the bottom surface of the joining cavity, said protrusions being spaced from said upper and lower front edges.

10. The cam-equipped connector assembly of claim 9 wherein said cam device comprises upper and lower walls connected by a side wall, the upper and lower walls being positioned adjacent said upper and lower front edges of the joining cavity of said female connector, said cam device sliding in a lateral direction along said upper and lower front edges of said joining cavity.

11. The cam-equipped connector assembly of claim 2 wherein said intermediary retaining device comprises an interengaging lug and a step.

12. The cam-equipped connector assembly of claim 11 wherein said lug is located in said male connector cavity and said step is located on said protrusion.

13. The cam-equipped connector assembly of claim 12 wherein said lug is shifted away from said step as said female and male connectors are moved from said intermediary-joined position to said fully-joined position.

14. The cam-equipped connector assembly of claim 8 wherein two protrusion extend side-by-side in the joining cavity.

15. The cam-equipped connector assembly of claim 14 wherein said protrusions are located between two rows of male contacts in said female connector.

16. The cam-equipped connector assembly of claim 15 wherein male contacts are located on each side of each said protrusions.

17. A female connector for use in a cam-equipped connector assembly, said female connector having a female housing with a female-joining cavity into which a mating male connector can be inserted when said male and female connectors are joined, said female connector being equipped with a cam device for moving said connector from an intermediary-joined position to the fully-joined position, characterized in that at least one protrusion is located in said joining cavity of said female connector adjacent the middle of said joining cavity, said protrusion extending to the front of the joining cavity to engage the male connector and prevent insertion of said misaligned male connector into either said intermediary-joined position or said fully-joined position when said cam device is in a fully-inserted position, and that said protrusion includes an intermediary retaining device engagable with said male connector to temporarily retain said female and male connectors in the intermediary-joined position.

18. The female connector of claim 17 wherein contacts are positioned in said joining cavity of said female connector, said protrusion extending beyond a contact section of said contacts so that a misaligned male connector will not damage said contacts when said male connector is joined to said female connector.

* * * * *